US008387581B2

(12) United States Patent
Goldin et al.

(10) Patent No.: US 8,387,581 B2
(45) Date of Patent: Mar. 5, 2013

(54) ASSEMBLY AND METHOD FOR CONTROLLING AN AIR INTAKE RUNNER

(75) Inventors: Iliya Goldin, Rochester, MI (US); Raffik Said, Rochester Hills, MI (US); Eric E. Pain, Fisherville, VA (US); Thomas Kern, Rochester Hills, MI (US); Francis V. Rolland, Rochester Hills, MI (US)

(73) Assignee: Mark IV Systemes Moteurs USA, Inc., Rochester Hills, MI (US)

( * ) Notice: Subject to any disclaimer, the term of this patent is extended or adjusted under 35 U.S.C. 154(b) by 0 days.

(21) Appl. No.: 13/462,098

(22) Filed: May 2, 2012

(65) Prior Publication Data

US 2012/0210970 A1 Aug. 23, 2012

Related U.S. Application Data

(60) Continuation of application No. 13/218,051, filed on Aug. 25, 2011, now Pat. No. 8,191,526, which is a division of application No. 12/206,941, filed on Sep. 9, 2008, now Pat. No. 8,028,677.

(51) Int. Cl.
*F02M 35/10* (2006.01)

(52) U.S. Cl. ..... 123/184.55; 123/184.56; 123/184.53; 123/336

(58) Field of Classification Search ..... 123/184.53–184.57, 336, 337, 123/184.47, 184.24, 184.61, 184.51
See application file for complete search history.

(56) References Cited

U.S. PATENT DOCUMENTS

| | | | | |
|---|---|---|---|---|
| 4,907,547 | A * | 3/1990 | Daly | 123/184.53 |
| 5,715,782 | A * | 2/1998 | Elder | 123/184.61 |
| 6,135,418 | A * | 10/2000 | Hatton | 251/306 |
| 6,763,802 | B1 * | 7/2004 | Brassell | 123/336 |
| 7,162,997 | B2 * | 1/2007 | Madeira | 123/336 |
| 7,434,559 | B2 * | 10/2008 | Park | 123/184.53 |
| 2003/0136936 | A1 * | 7/2003 | Krause | 251/305 |
| 2007/0084437 | A1 * | 4/2007 | Winkelmuller et al. | 123/336 |

* cited by examiner

*Primary Examiner* — Noah Kamen
*Assistant Examiner* — Hung Q Nguyen
(74) *Attorney, Agent, or Firm* — Thompson Hine L.L.P.

(57) ABSTRACT

A subassembly for a valve device for controlling air flow in an intake manifold. The subassembly includes a cartridge including a plurality of compartments having partially open opposing sidewalls, wherein adjacent partially open side walls of adjacent compartments are spaced apart a distance to define a groove therebetween, a plurality of partitions each having a through-hole therein and being disposed in the grooves defined between adjacent partially open side walls of the adjacent compartments. The partitions complete the formation of the opposing side walls of the adjacent compartments and each compartment is alignable with an air intake runner of an intake manifold.

23 Claims, 3 Drawing Sheets

ASSEMBLY AND METHOD FOR CONTROLLING AN AIR INTAKE RUNNER

RELATED APPLICATIONS

This application is a continuation of U.S. application Ser. No. 13/218,051, filed Aug. 25, 2011, which is a divisional of U.S. application Ser. No. 12/206,941, filed Sep. 9, 2008, now U.S. Pat. No. 8,028,677, issued Oct. 4, 2011.

BACKGROUND OF THE INVENTION

1. Field of the Invention

The present invention generally relates to air intake manifolds for internal combustion engines. In particular, the present invention is directed to an assembly and method for controlling an air intake runner of an air intake manifold in a naturally aspirated gas engine.

2. Description of the Related Art

It is generally known in the art of internal combustion engines that the length of the air intake runners between an intake air plenum and the engine cylinders impacts the power or torque output over a range of engine speeds. For example, long runners are preferred to obtain high torque output at low engine speeds, i.e., low revolutions per minute (RPMs). Conversely, short runners help provide high torque output at high engine speeds. It is also generally known that torque output reduces quickly at elevated RPM levels when only long runners are utilized. Also, the use of short runners at reduced RPM levels does not provide high torque.

Short/long runner control systems are known in the art for switching the short air intake runners between open and closed modes depending on the speed of the engine. Known systems are generally fabricated from a single material such as aluminum or plastic and require intensive machining or tooling to both fabricate and install in an intake manifold. Existing systems often have a reduced structural integrity due to their one-material construction. Finally, existing systems are often rigid and are not easy to adjust for varying operating conditions.

BRIEF SUMMARY OF THE INVENTION

One aspect of the present invention is an assembly for controlling an air intake runner of an air intake manifold. The assembly includes a cartridge including a plurality of compartments. Each of the compartments has end walls and partial side walls that are joined to define a central opening and an outer perimeter. The partial side walls of adjacent compartments are spaced apart to define a groove between each of the compartments. The cartridge is adapted for connecting with the air intake manifold. The assembly also includes bushing carriers that have substantially central openings. Each of the bushing carriers is configured to be snap-fit into one of the grooves of the cartridge. The assembly further includes bushings configured to rotatably fit within the central openings of the bushing carriers. Each of the bushings has an outer rim and an open center. Flaps including a slot and having a shape configured to substantially adjustably seal the central opening are also included and a shaft is included that extends through the slots of the flaps and the open centers of the bushings.

Another aspect of the invention is an assembly for controlling an air intake runner of an air intake manifold. The assembly includes a cartridge reinforced with bushing carriers having bushings. The cartridge is joined with the air intake manifold. A shaft is threaded through the bushings and through a plurality of flaps, which are each positioned to seal an adjacent air intake runner. The cartridge includes a plurality of compartments, each of the compartments having end walls and partial side walls that are joined to define a central opening and an outer perimeter. Each of the partial side walls has a substantially open central portion. The partial side walls of adjacent compartments are spaced apart to define a groove between each of the compartments. The cartridge is fabricated from a reinforced material and is adapted for connecting with the air intake manifold so that the outer perimeter of each of the plurality of compartments is in substantial axial alignment with the air intake runner below it. The bushing carriers typically have substantially central openings and are generally fabricated from a material having low friction characteristics. Each of the bushing carriers is configured to be snap-fit into one of the grooves of the cartridge thereby substantially closing the substantially open central portion of the partial side wall. The bushings are configured to rotatably fit within the central openings of the bushing carriers. Each of the bushings has an outer rim and an open center. The flaps have a shape substantially defined by the outer perimeter and include a slot. The flaps are configured to substantially seal the air intake runner when in a closed position. The shaft extends through the slots of the flaps and the open centers of the bushings. When the shaft is rotated, the flaps are rotated simultaneously.

Still another aspect of the invention is a method of modifying an air intake manifold to control air intake runners. The method includes the following steps: providing a cartridge including a plurality of compartments, each spaced apart to define a groove therebetween; snap-fitting a bushing carrier having a rotatable bushing into each of the grooves; positioning a flap having a slot over each of the compartments; inserting a shaft through each slot and each bushing thereby rotatably retaining each of the flaps within one of the plurality of compartments; positioning the cartridge over the air intake manifold so that each of the plurality of compartments is substantially axially aligned with one of the air intake runners; and removably connecting the cartridge with the air intake manifold.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION

Figure 1:
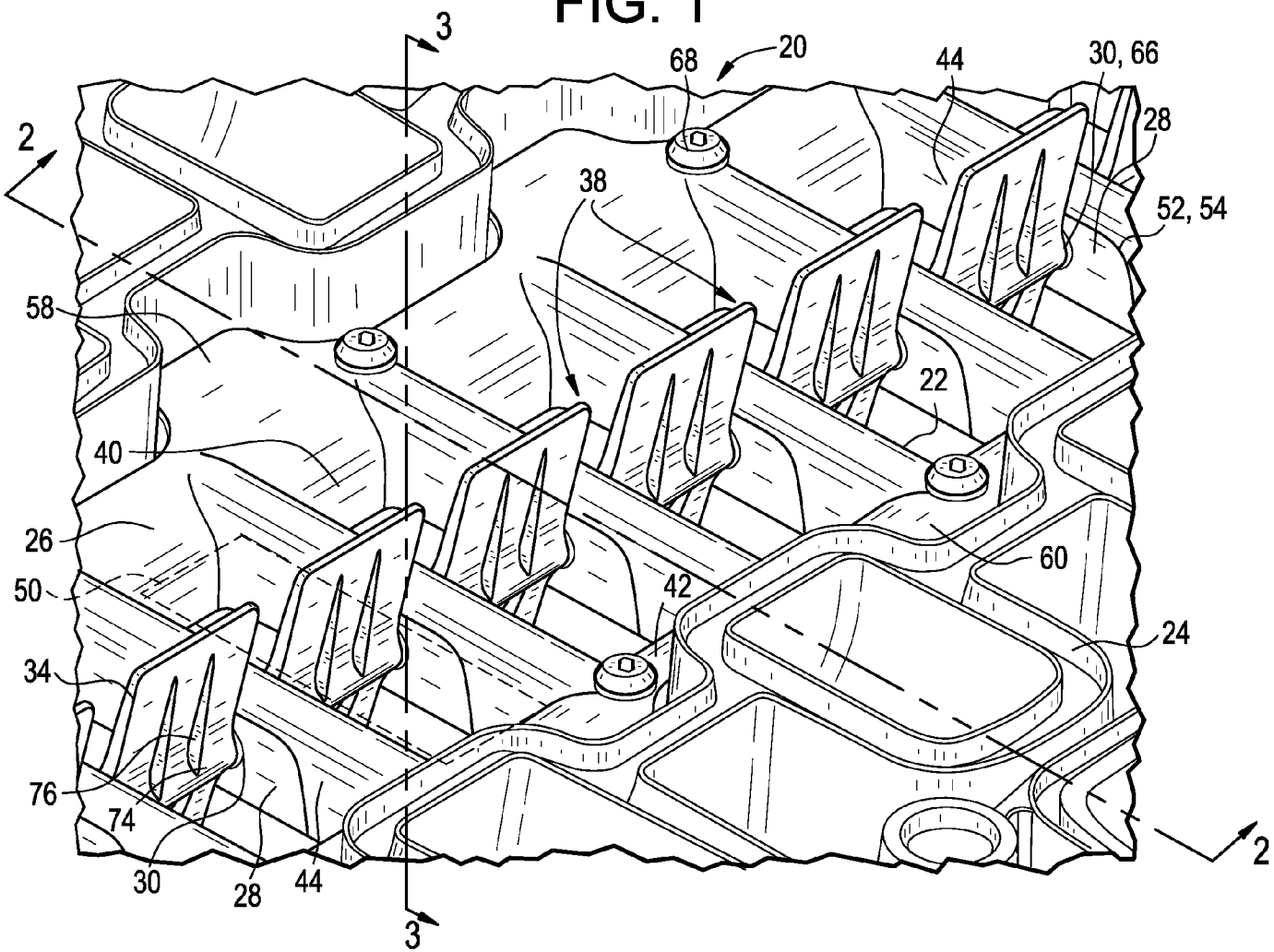
FIG. 1 is a top isometric view of an assembly according to one embodiment of the present invention.
Figure 2:
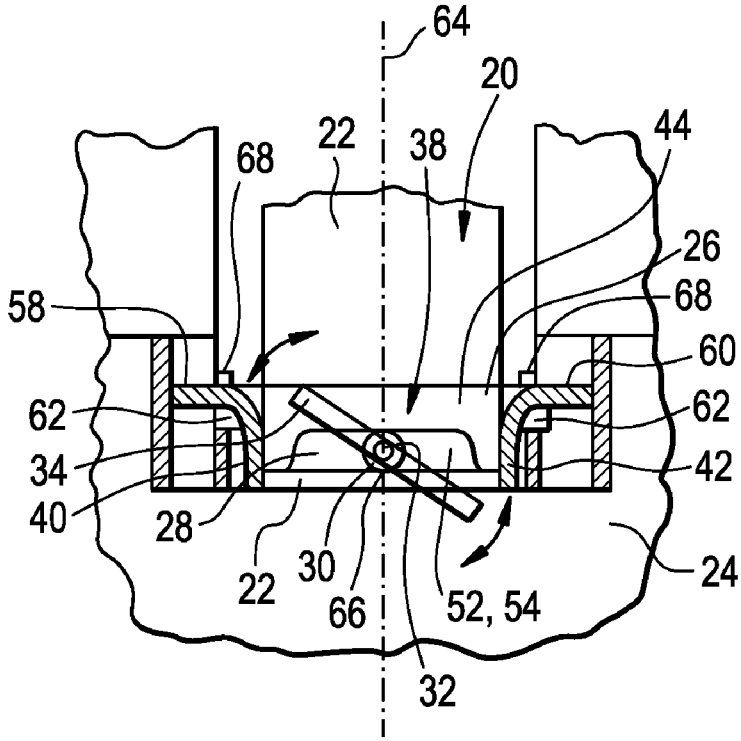
FIG. 2 is a section view taken along line 2-2 of FIG. 1.
Figure 3:
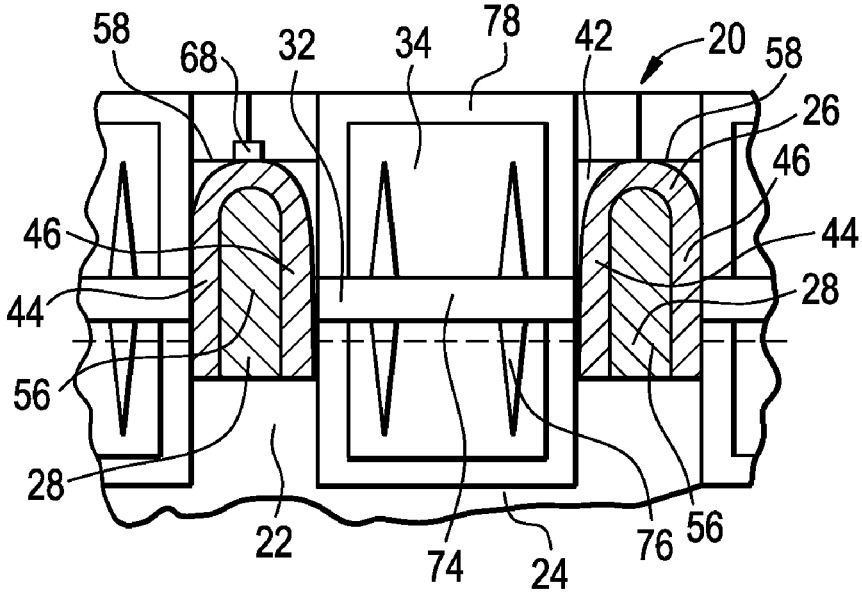
FIG. 3 is a section view taken along line 3-3 of FIG. 1.
Figure 4:
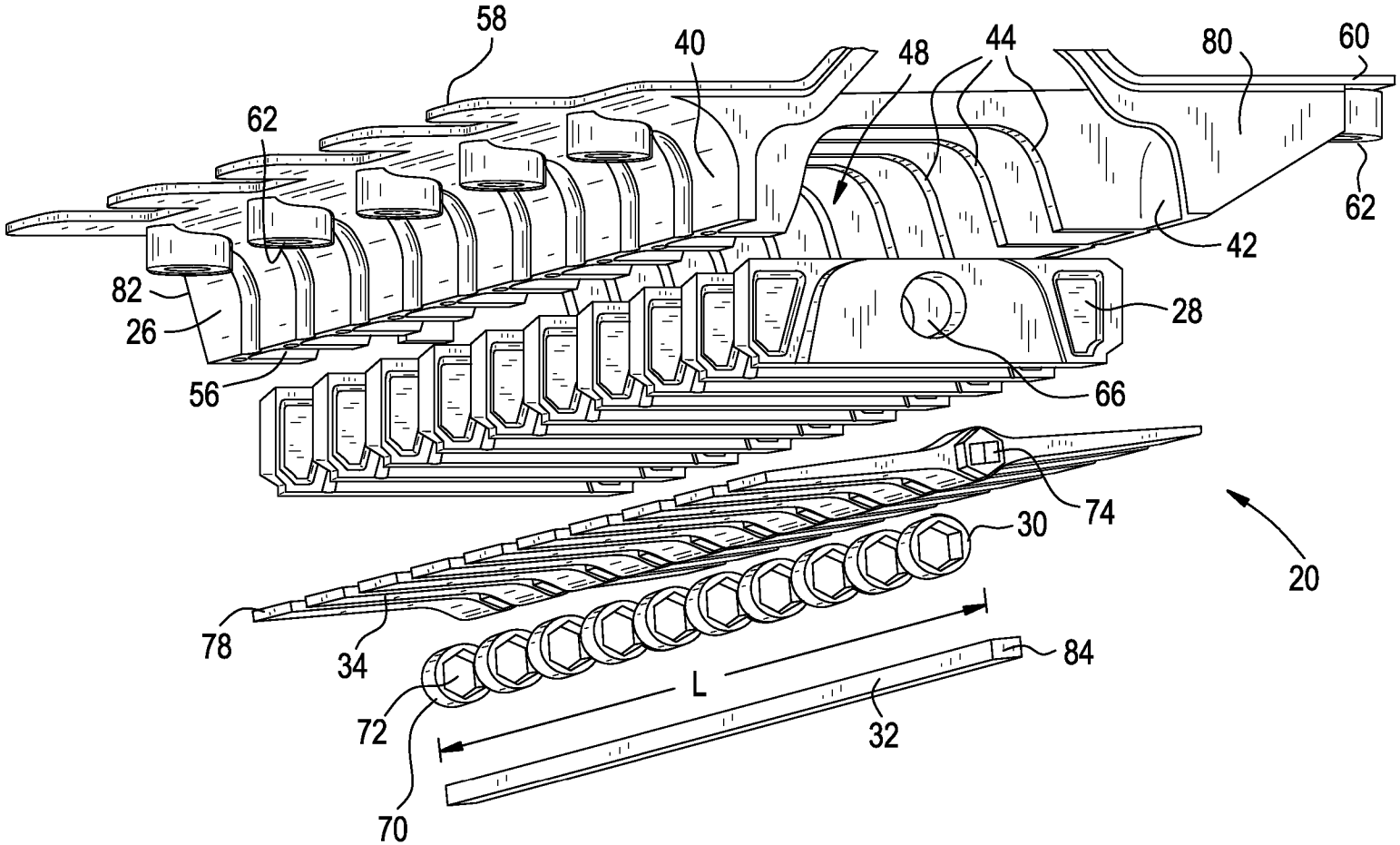
FIG. 4 is an exploded view of an assembly according to one embodiment of the present invention.

Referring now to the drawings in which like reference numerals indicate like parts, and in particular, to FIGS. 1-4, one aspect of the present invention is an assembly 20 for controlling an air intake runner 22, e.g., a short runner, of an air intake manifold 24. In one embodiment, a cartridge 26 reinforced with bushing carriers 28 having bushings 30 is joined with air intake manifold 24. A shaft 32 is threaded through the bushings and through a plurality of flaps 34, which are each positioned to seal an adjacent air intake runner 22.

Cartridge 26 generally includes a plurality of compartments 38. Each of plurality of compartments 38 typically has opposing end walls 40 and 42, and opposing partial side walls 44 and 46. End walls 40 and 42, and opposing partial side walls 44 and 46, are joined to define a central opening 48 and an outer perimeter 50. Each of partial side walls 44 and 46 typically has substantially open central portions 52 and 54. Partial side walls 44 and 46 of adjacent compartments are generally spaced apart to define a groove 56 between each of the compartments. Partial side walls 44 and 46 typically include mating surfaces 58 and 60, which extend outwardly from each of the walls. Mating surfaces 58 and 60 may include bolt holes 62 or similar for joining cartridge 26 with air intake manifold 24. Cartridge 26 is generally connected with air intake manifold 24 so that outer perimeter 50 of each of the plurality of compartments 38 is in substantial axial alignment along an axis 64 with air intake runner 22 positioned below it. Cartridge 26 is generally fabricated from a reinforced lightweight material that is rigid enough to withstand the harsh environmental conditions it will operate in, yet flexible enough to bend for snap-fitting to other parts of assembly 20. Internal air pulsations and backfire demand that the components of assembly 20 be robust in function while meeting customer requirements for noise, vibration, harshness (NVH) and airflow. Examples of such materials include glass fiber reinforced plastics such as PA6 30% GF, PA66 33% GF, or similar, which provide additional structural integrity to the assembly.

Bushing carriers 28 include substantially central openings 66 and are generally rectangular in shape but may be configured in any shape capable of being snap-fit into one of grooves 56 of cartridge 26. Although not shown, bushing carriers 28 may include detents, tabs, indents, or other features that allow them to be snap-fit into grooves 56. When positioned with groove 56, bushing carriers 28 substantially close open central portions 52 and 54 of partial side walls 44 and 46. When cartridge 26 is bolted to air intake manifold 24, bolts 68 and mating surfaces 58 provide rigidity in one direction and bushing carriers 28 provide rigidity in an opposing direction. To facilitate fabrication and machining of central openings 66, bushing carriers 28 are generally being fabricated from a low friction plastic, e.g., PA66, PA12, or similar.

Bushings 30 include an outer rim 70 and an open center 72 and are configured to rotatably fit within central openings 66 of bushing carriers 28. Bushings 30 are adapted to spin inside bushing carriers 28. Bushings are generally fabricated from a low friction material, e.g., plastic.

Flaps 34 generally have a shape similar to a shape defined by outer perimeter 50 and including a slot 74. Flaps 34 may also include reinforcing members 76. Flaps 34 are generally configured to substantially seal adjacent air intake runners 22 when in a closed position. In one embodiment, flaps 34 include an outer portion 78 for sealing air intake runner 22. Outer portion 78 is typically formed from an over molded rubber material.

Shaft 32 is generally a steel member having a length L that extends from a first end 80 of cartridge 26 to an opposite second end 82 and runs parallel to end walls 40 and 42 of the cartridge. Shaft 32 has a cross-sectional shape 84 that is shaped to engage open center 72 of bushing 30. Shaft 32 is positioned in cartridge 26 to extend through slots 74 of flaps 34 and open centers 72 of bushings 30. When shaft 32 is rotated, flaps 34 and bushings 30 are rotated simultaneously. Within the limits of the geometry of each of plurality of compartments 38, flaps 34 and bushings 30 are configured to slide along length L of shaft 32 thereby allowing for self-adjustment.

Another embodiment of the present invention is a method of modifying an air intake manifold to control air intake runners, e.g., short runners. The method first includes providing a cartridge including a plurality of compartments. Each of the compartments is spaced apart to define a groove therebetween. Next, bushing carriers are snap-fit into each of the grooves between the compartments. Then, a flap having a slot is positioned over each of the compartments. Next, a shaft is inserted through each slot and each bushing to retain each of the flaps within a compartment. In this way, the flaps are rotatably retained by the shaft and may be rotated by the shaft. Then, the cartridge is positioned over the air intake manifold so that each of the plurality of compartments is substantially axially aligned with one of the air intake runners. Finally, the cartridge is removably connected, e.g., bolted or screwed, to the air intake manifold. The air intake runner may be controlled by rotating the shaft from a first position to a second position to simultaneously open and close the flaps.

An active air intake manifold typically includes two sets of runners, i.e., long runners and short runners that extend from an air intake plenum to each engine cylinder. When using an embodiment of the present invention, at low RPM, the flaps may be rotated to substantially close off the short runners while letting the airflow through the long runners. At high RPM, the flaps may be rotated to allow the plenum air to flow through the short runners thereby providing greater horsepower capability.

The assembly and method of the present invention offers advantages over existing solutions. The use of a mixed-material fabrication offers a significant cost reduction over known single-material systems. The use of reinforced plastic components helps reduce and/or eliminate NVH issues, such as knocking noises experienced with many current solutions and eases the optimization of geometric and material characteristics. Plastic has a lower density and wider range of elastic deformation. Due to this, plastic parts can better absorb impact without making extensive chattering noises.

The use of a cartridge formed from reinforced materials provides increased design robustness and reliability over prior art assemblies that include non-reinforced plastic cartridges. A design that allows for snap-fit assembly provides increased quality by simplifying the fabrication and assembly processes. Snap-fit assembly also provides built-in self-adjusting capabilities.

Self-adjustment of the flaps and bushings helps compensate for the geometrical variations due to the differing thermal expansion rates of the materials as well as process variations. This self-aligning feature reduces the fabrication tolerances, simplifies the assembly, and eliminates the need for a thrust mechanism. This characteristic is also compatible with the use of a rubber over mold on the flaps to provide a positive seal when the flaps are rotated to close off the short runner thereby improving low RPM performance.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

What is claimed is:

1. A subassembly for a valve device for controlling air flow in an intake manifold, the subassembly comprising:

a cartridge including a plurality of compartments having partially open opposing sidewalls, wherein adjacent partially open side walls of adjacent compartments are spaced apart a distance to define a groove therebetween;

a plurality of partitions each having a through-hole therein, the partitions being disposed in the grooves defined between adjacent partially open side walls of the adjacent compartments, wherein the partitions complete the formation of the opposing side walls of the adjacent compartments;

wherein each compartment of the cartridge is alignable with an air intake runner of an intake manifold.

2. The subassembly of claim 1, further comprising a plurality of flaps each having a through-slot for receiving a shaft, wherein each flap is disposed within one of the plurality of compartments.

3. The subassembly of claim 2, further comprising a shaft capable of rotating the flaps, the shaft being inserted through the through-holes in the partitions and the through-slot in the flaps.

4. The subassembly of claim 3, wherein each flap includes a connecting portion having an opening with a non-round cross-section and the shaft has a cross-section substantially equivalent to the non-round cross-section of the opening of the connecting portion of each flap.

5. The subassembly of claim 1, wherein the partitions are snap-fit into the grooves of the cartridge.

6. The subassembly of claim 1, wherein the partitions are formed of or include a low friction plastic.

7. The subassembly of claim 1, further comprising a plurality of bushings, wherein the bushings are positionable in the through-holes of the partitions with one bushing per through-hole.

8. The subassembly of claim 2, wherein, when in a closed position, each flap is shaped to substantially seal the air intake runner aligned with the compartment in which the flap is disposed.

9. The subassembly of claim 8, wherein each flap includes an outer portion for sealing the compartment in which the flap is positioned, the outer portion being formed from an overmolded rubber material.

10. The subassembly of claim 3, wherein each flap is slideable along a length of the shaft such that each flap is self-aligning.

11. The subassembly of claim 1, wherein the grooves of the cartridge are oriented generally transverse to a longitudinal axis of the cartridge and the portion of the cartridge defining the grooves is flexible enough to bend for snap-fitting the partitions therein.

12. The subassembly of claim 1, wherein the cartridge is formed of or includes a reinforced plastic and the partitions are formed of or include a non-reinforced plastic.

13. A kit for controlling air flow in an intake manifold, the kit comprising:

a cartridge including a plurality of compartments having partially open opposing sidewalls, wherein adjacent partially open side walls of adjacent compartments are spaced apart a distance to define a groove therebetween;

a plurality of partitions each having a through-hole therein, the partitions being receivable in the grooves defined between adjacent partially open side walls of the adjacent compartments to complete the formation of the opposing side walls of the adjacent compartments;

wherein each compartment of the cartridge is alignable with an air intake runner of an intake manifold.

14. The kit of claim 13, further comprising a plurality of flaps each having a through-slot for receiving a shaft, wherein each flap is disposable within one of the plurality of compartments.

15. The kit of claim 14, further comprising a shaft capable of rotating the flaps, the shaft being insertable through the through-holes in the partitions and the through-slot in the flaps.

16. The kit of claim 14, wherein each flap includes a connecting portion having an opening with a non-round cross-section and the shaft has a cross-section substantially equivalent to the non-round cross-section of the opening of the connecting portion of each flap.

17. The kit of claim 13, wherein the partitions are snap-fittable into the grooves of the cartridge.

18. The kit of claim 13, wherein the partitions are formed of or include a low friction plastic.

19. The kit of claim 13, further comprising a plurality of bushings, wherein the bushings are positionable in the through-holes of the partitions with one bushing per through-hole.

20. The kit of claim 14, wherein, when in a closed position, each flap is shaped to substantially seal the air intake runner aligned with the compartment in which the flap is disposed.

21. The kit of claim 20, wherein each flap includes an outer portion for sealing the compartment in which the flap is positioned, the outer portion being formed from an overmolded rubber material.

22. The kit of claim 13, wherein the grooves of the cartridge are oriented generally transverse to a longitudinal axis of the cartridge and the portion of the cartridge defining the grooves is flexible enough to bend for snap-fitting the partitions therein.

23. The kit of claim 13, wherein the cartridge is formed of or includes a reinforced plastic and the partitions are formed of or include a non-reinforced plastic.

* * * * *